US012011032B2

(12) United States Patent
Whitson, Jr.

(10) Patent No.: US 12,011,032 B2
(45) Date of Patent: Jun. 18, 2024

(54) CARTRIDGE WITH SMOKING ARTICLE THEREIN

(71) Applicant: Douglas John Whitson, Jr., Hammonton, NJ (US)

(72) Inventor: Douglas John Whitson, Jr., Hammonton, NJ (US)

( * ) Notice: Subject to any disclaimer, the term of this patent is extended or adjusted under 35 U.S.C. 154(b) by 591 days.

(21) Appl. No.: 17/231,272

(22) Filed: Apr. 15, 2021

(65) Prior Publication Data

US 2021/0321661 A1 Oct. 21, 2021

Related U.S. Application Data

(60) Provisional application No. 63/010,076, filed on Apr. 15, 2020.

(51) Int. Cl.

| | |
|---|---|
| ***A24D 1/14*** | (2006.01) |
| ***A24D 3/04*** | (2006.01) |
| ***A24F 1/30*** | (2006.01) |
| ***A24F 5/10*** | (2006.01) |

(52) U.S. Cl.

CPC ..... *A24D 1/14* (2013.01); *A24D 3/041* (2013.01); *A24F 1/30* (2013.01); *A24F 5/10* (2013.01)

(58) Field of Classification Search

CPC ..... A24F 1/30

See application file for complete search history.

(56) References Cited

U.S. PATENT DOCUMENTS

| | | | | |
|---|---|---|---|---|
| 4,506,392 | A * | 3/1985 | White | A41B 11/14 2/409 |
| 2002/0176761 | A1* | 11/2002 | Nehl | F16B 13/124 411/36 |
| 2010/0252057 | A1* | 10/2010 | Saleh | A24F 1/30 131/173 |
| 2017/0172203 | A1* | 6/2017 | Gebara | A24D 1/14 |
| 2019/0373945 | A1* | 12/2019 | Kleppen | A24D 3/0275 |
| 2020/0200300 | A1* | 6/2020 | Zhang | F16L 11/04 |
| 2022/0220994 | A1* | 7/2022 | Kaiser | F16B 31/06 |

* cited by examiner

*Primary Examiner* — Philip Y Louie
*Assistant Examiner* — Jeffrey A. Buckman
(74) *Attorney, Agent, or Firm* — Ashok Tankha

(57) ABSTRACT

A smoking cartridge configured to removably engage with the bowl of a smoking apparatus comprises a receptacle, a sealing member, and an opening that comprises inwardly projecting flaps. The receptacle is configured to contain a smoking material. The sealing member is disposed along the periphery of the receptacle proximal to a lower portion of the receptacle. The sealing member is configured to removably engage and seal with the bowl of the smoking apparatus. The opening is disposed at a bottom of the receptacle, which is defined by inwardly projecting adjustable flaps. The flaps are configured to be adjustably bent to vary the size of the opening.

8 Claims, 19 Drawing Sheets

CARTRIDGE WITH SMOKING ARTICLE THEREIN

CROSS-REFERENCE TO RELATED APPLICATIONS

This application claims priority to and the benefit of the provisional patent application titled "Cartridge with Smoking Article Therein", application No. 63/010,076, filed in the United States Patent and Trademark Office on Apr. 15, 2021. The specification of the above referenced patent application is incorporated herein by reference in its entirety.

BACKGROUND

The apparatus disclosed herein, in general, relates to a smoking apparatus, for example a pipe, bong, etc., for holding and smoking a smoking material. As used herein, a bong is a device that filters the smoke produced by the burning *cannabis* through water, prior to the of the smoke by a user. More particularly, the apparatus disclosed herein relates to a smoking cartridge configured for engaging with a bowl of a smoking apparatus for making the smoking cartridge readily and easily available for smoking, and for allowing the smoking cartridge to be disposed of in an efficient and hygienic manner after the smoking material has been smoked by the user.

*Cannabis* is an example of a smoking material. Besides the use of *cannabis* for recreational purposes, *cannabis* is prescribed by medical professionals to users for several medical conditions. For example, *cannabis* is prescribed to persons who have reduced dexterity or lost dexterity in their hands and fingers. A user needs to perform the time-consuming and dexterous task of removing the *cannabis* flower from the *cannabis* plant, removing the small and large stems from the *cannabis* flower, breaking the *cannabis* flower into small administrable pieces, placing the *cannabis* flower in a grinder, grinding the *cannabis* flower in the grinder into a powder like substance which may require substantial effort to grind, and transferring the ground *cannabis* flower to the smoking bowl of the pipe, or a bong, in the proper dosage amount. Therefore, there is a need for providing predetermined doses of a smoking material, for example, *cannabis* flower, in a ready to consume package that can be directly loaded into a user's smoking apparatus to allow the user to smoke the *cannabis* material directly from the package in which the *cannabis* material is marketed.

There is also a need for a cartridge prefilled with a smoking material that engages with the bowl of a majority of smoking pipes, bongs, etc.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

Disclosed herein is a cartridge prefilled with the smoking material configured to engage with the bowl of a smoking apparatus, for example, a smoking pipe, bong, etc. The smoking cartridge comprises a receptacle, a sealing member, and an opening that comprises inwardly projecting flaps. The receptacle is configured to contain a smoking material. The sealing member is disposed along the periphery of the receptacle proximal to a lower portion of the receptacle. The sealing member is configured to engage with the bowl of the smoking apparatus. In an embodiment, the flaps are configured to be adjustably bent inward or outwards to vary the size of the opening.

The flaps allow smoke generated by the combustion of the smoking material to exit from the bottom of the smoking cartridge. In an embodiment, the smoking cartridge further comprises a removable lid secured to an open end at a top portion of the receptacle. The lid comprises multiple perforations to allow air to enter the receptacle. In an embodiment, the lid is non-removably secured to the top portion of the receptacle to preclude the smoking material from being accessed or tampered with.

In an embodiment, the perforations on the lid are sealed using a tamper proof seal, wherein the tamper proof seal is removed prior to using the smoking cartridge. The removal of the tamper proof seal opens the perforations in the lid to allow a user to draw air through the smoking cartridge for smoking the smoking material using the smoking apparatus. In an embodiment, the smoking cartridge further comprises a screen disposed over the opening at the bottom of the receptacle to preclude the smoking material in the receptable from falling out from the bottom of the receptacle. In an embodiment, a flap comprising a substantially star shaped structure that defines the opening, precludes the screen from falling through the opening. In an embodiment, the smoking cartridge further comprises a stabilizer attached to the sealing member. The stabilizer comprises one or more of an adhesive layer and a threaded extension.

In an embodiment, the adhesive layer removably engages with the bowl of the smoking apparatus to engage the smoking cartridge with the bowl. In an embodiment, the adhesive layer disposed on a ring of the sealing member is a non-toxic and heat resistant adhesive, which creates an air tight rigid engagement between the lower part of the receptacle and the bowl of the smoking apparatus. In an embodiment, the threaded extension comprises a threaded surface, which provides an air tight seal between the smoking cartridge and the bowl when the smoking cartridge is engaged with the bowl. In an embodiment, the threaded surface of the threaded extension is formed by intertwining multiple elongate elastic members to provide substantially elastic properties to the threaded extension to securely fit within the bowl.

In an embodiment, the smoking cartridge further comprises a stabilizer comprising one or more of adhesive strips attached to the lid for securing the smoking cartridge to the smoking apparatus. In an embodiment, adhesive strips are attached to the lid of the smoking cartridge. The adhesive strips comprise an adhesive layer that is applied on one side of the adhesive strip, with the adhesive strips attached to the lid of the smoking cartridge. The lid is secured to the receptacle and the adhesive strips are secured to the pipe to securely engage the smoking cartridge to the smoking apparatus. In an embodiment, the sealing member is threaded, where the threaded sealing member securely engages with an inner wall of bowl of the smoking apparatus when the smoking cartridge is inserted into the bowl of the smoking apparatus.

BRIEF DESCRIPTION OF DRAWINGS

The following detailed description of the invention, is better understood when read in conjunction with the appended drawings. For illustrating the invention, exemplary constructions of the invention are shown in the drawings. However, the invention is not limited to the specific structures or components disclosed herein. The description of a structure or component referenced by a numeral in a drawing is applicable to the description of that structures or components shown by that same numeral in any subsequent drawing herein.

DETAILED DESCRIPTION OF THE INVENTION

Figure 1:
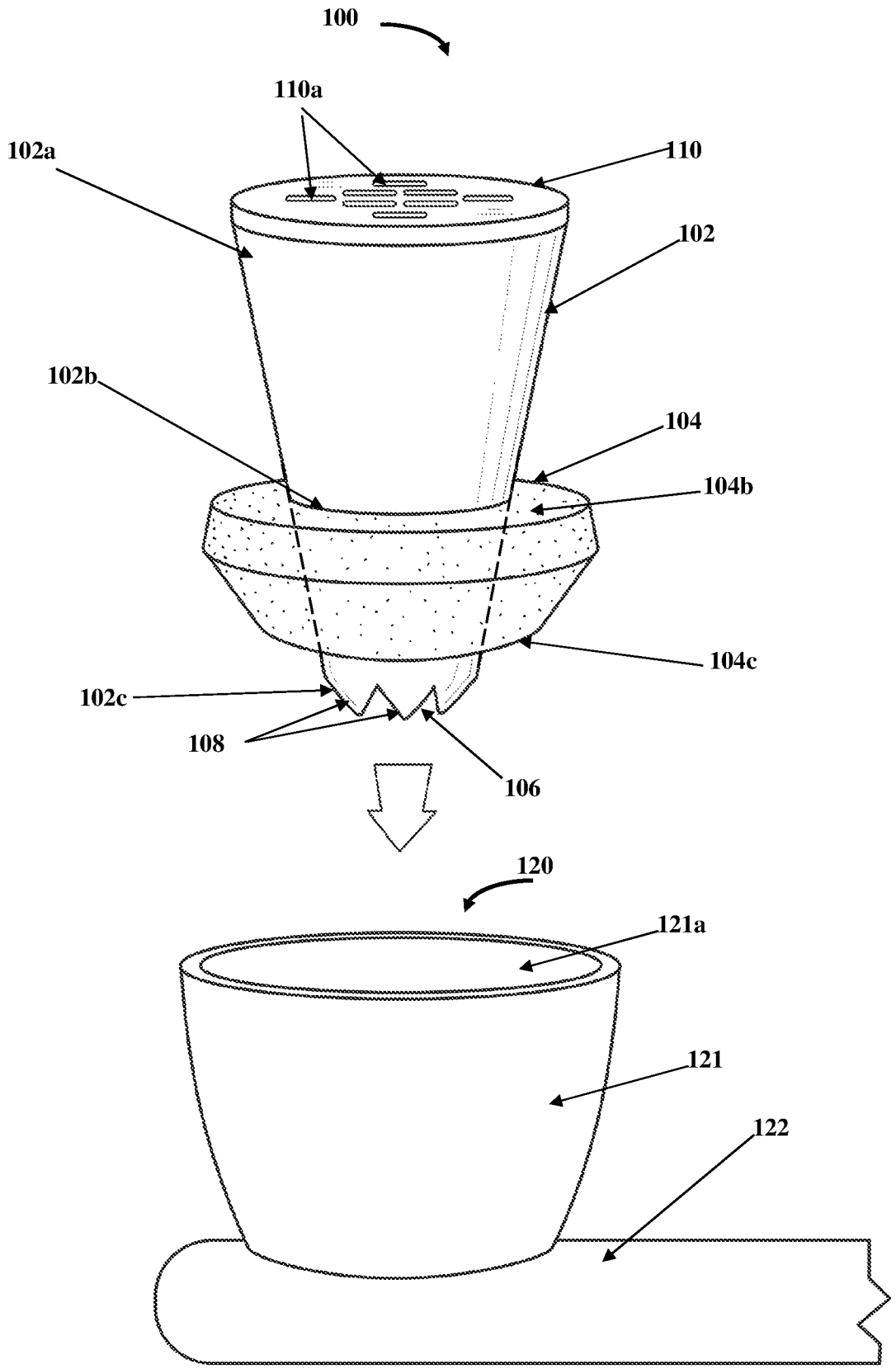
FIG. 1 illustrates a front elevational view of a first embodiment of a smoking cartridge and a smoking apparatus.
Figure 2:
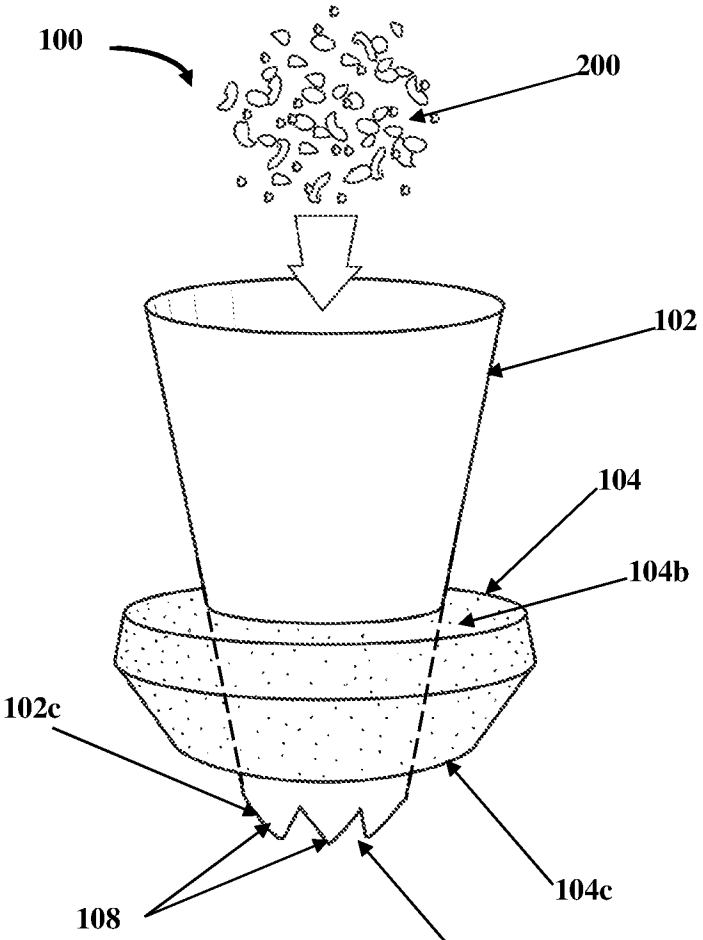
FIG. 2 illustrates a front elevation view showing a receptacle of the first embodiment of the smoking cartridge, corresponding to FIG. 1, with the smoking material being loaded into the receptacle.
Figure 8B:
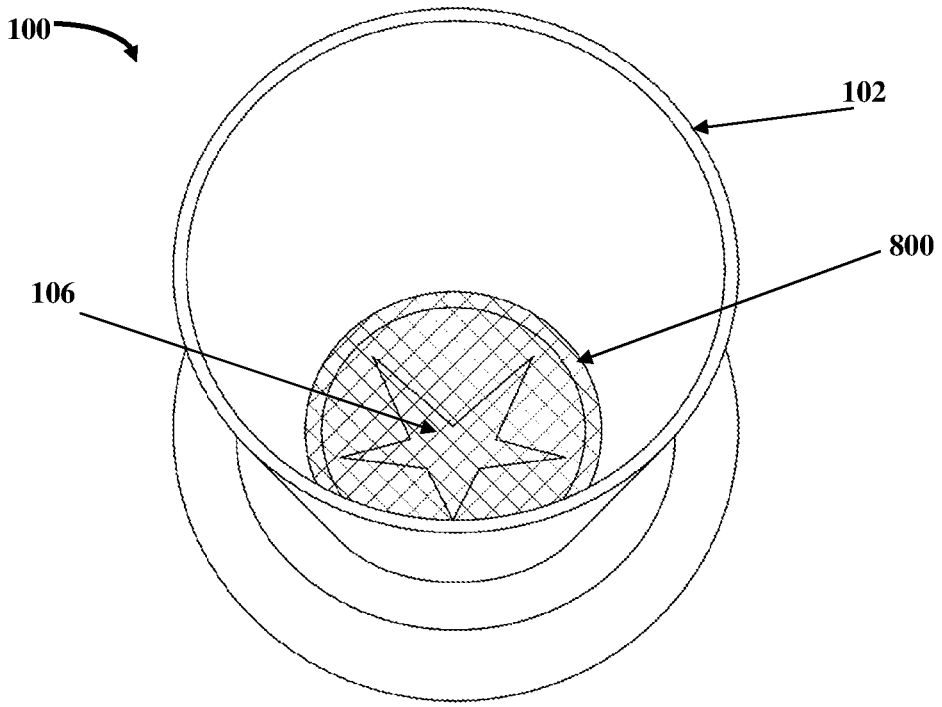
FIG. 8B illustrates a top perspective view of the first embodiment of the smoking cartridge illustrating a screen disposed over the opening to preclude the smoking material from falling down and out of the receptacle.
Figure 9A:
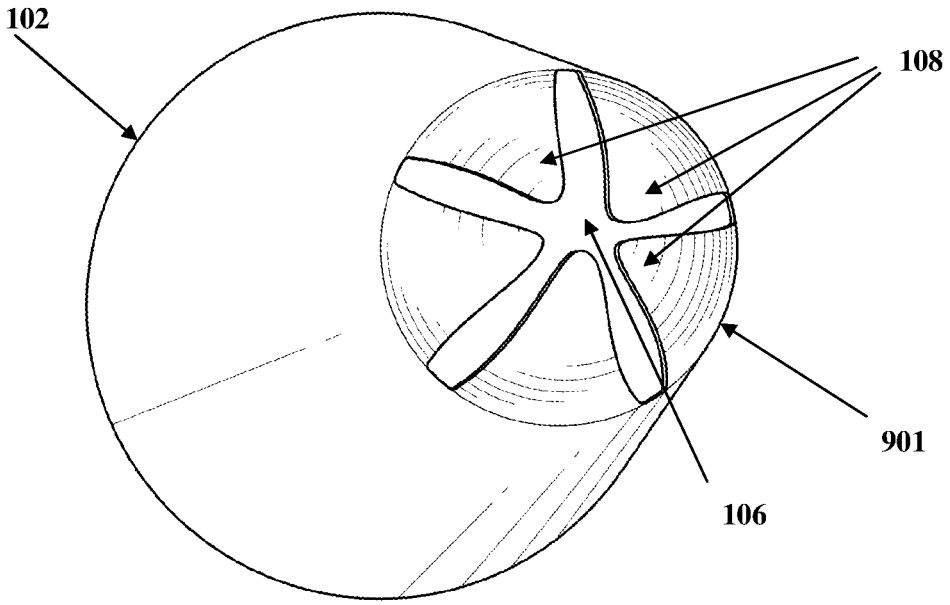
FIG. 9A illustrates a bottom isometric view of the receptacle of the first embodiment of the smoking cartridge, showing the flaps at the bottom of the receptacle.
Figure 9B:
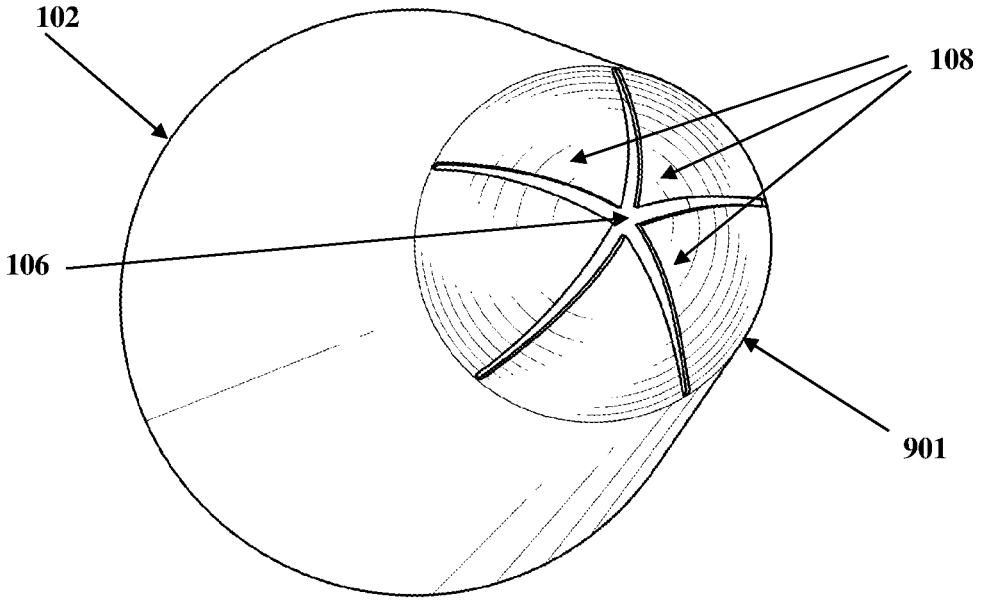
FIG. 9B illustrates a bottom isometric view of the receptacle of the first embodiment of the smoking cartridge showing flaps of the receptacle bent inwards.
Figure 9C:
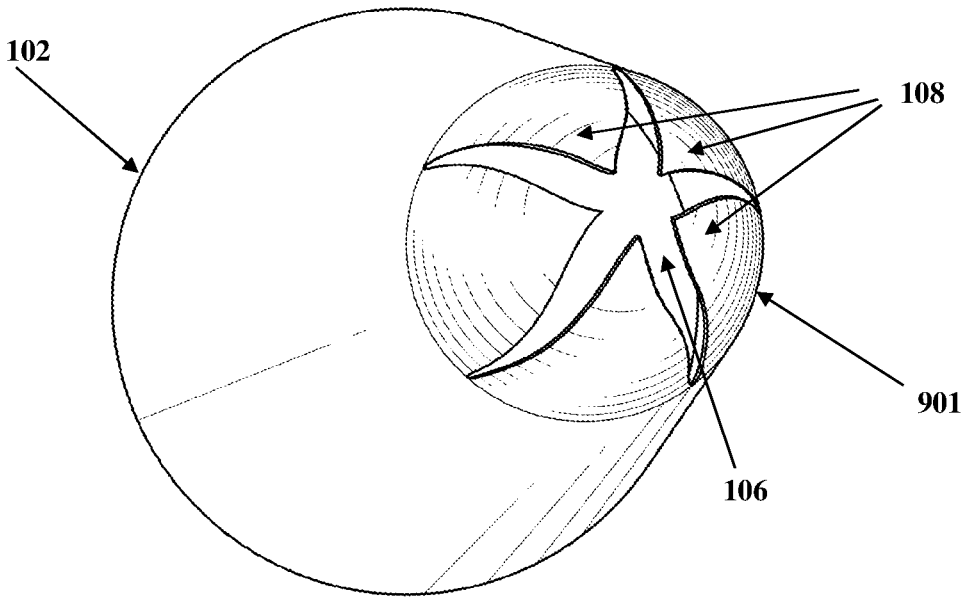
FIG. 9C illustrates a bottom isometric view of the receptacle of the first embodiment of the smoking cartridge showing flaps of the receptacle bent outwards.
Figure 18:
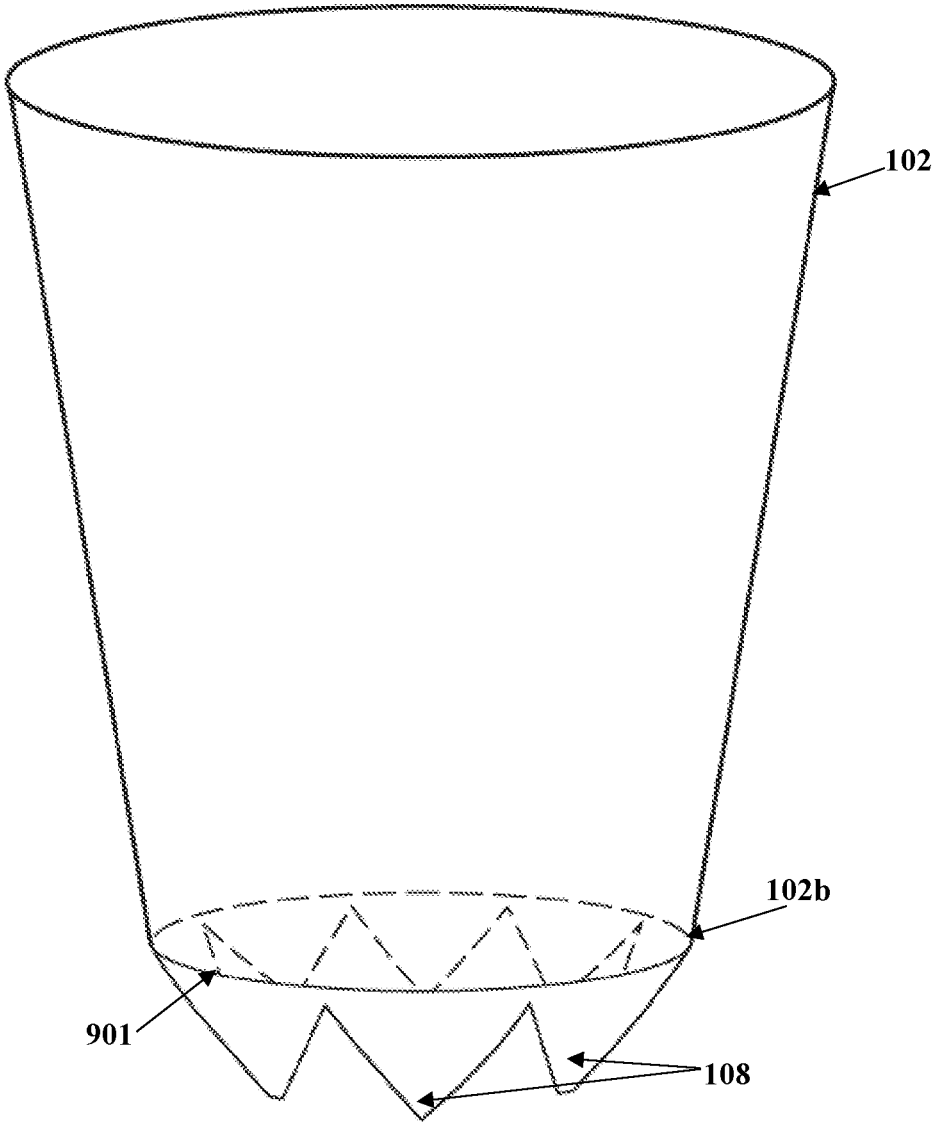
FIG. 18 illustrates hingedly attached flaps at a lower circular circumference of a frusto-conical shaped receptacle.

FIG. 1 illustrates a front elevational view of a first embodiment of a smoking cartridge 100 and a smoking apparatus 120. The smoking cartridge 100 is configured to engage the bowl 121 of a smoking apparatus 120. The smoking apparatus 120 is, for example, a smoking pipe 120, a bong 1600, etc. shown in FIG. 16, etc. The smoking cartridge 100 comprises a receptacle 102 configured to contain a smoking material 200, as shown in FIG. 2. The smoking cartridge 100 further comprises a sealing member 104 disposed along the periphery of the receptacle 102 proximal to a lower portion 102*b* of the receptacle 102. The receptacle 102 is made, for example, of a metal sheet, heat resistant polymer, ceramic, etc. The smoking cartridge 100 further comprises an opening 106 disposed at a bottom 102*c* of the receptacle 102. The opening 106 comprises inwardly projecting flaps 108 that extend from the bottom 102*c* of the receptacle 102, as shown in FIG. 9A. In an embodiment, the flaps 108 pivot about a circumference 901 of the bottom 102*c* of the receptacle 102, shown in FIGS. 9A-9C, to allow the opening 106 to be adjusted. The flaps 108 are made of the same material as the receptacle 102. In embodiment, the flaps 108 are configured to be adjustably bent inwards or outwards to vary the size of the opening 106. For example, the flaps 108 are configured to bend outwards and away from the bottom 102*c* of the receptacle 102 to increase the size of the opening 106 as shown in FIG. 9B. The flaps 108 are configured to be bent inwards and towards the bottom 102*c* of the receptacle 102 to decrease the size of the opening 106, as shown in FIG. 9C. In an embodiment, the flaps 108 are hingedly attached at the lower circular circumference 901 of the frusto-conical shaped receptacle 102, as illustrated in FIG. 18. The flaps 108 filter the smoke generated by the combustion of the smoking material 200 and allow the filtered smoke to exit from the bottom 102*c* of the receptacle 102 of the smoking cartridge 100, but preclude the smoking material 200 from falling out of the smoking cartridge 100 from the bottom 102*c* of the receptacle 102. In an embodiment, as shown in FIG. 8B, a screen 800 is installed above opening 106 to preclude the smoking material 200 from falling out from the bottom of the receptacle 102.

Figure 3:
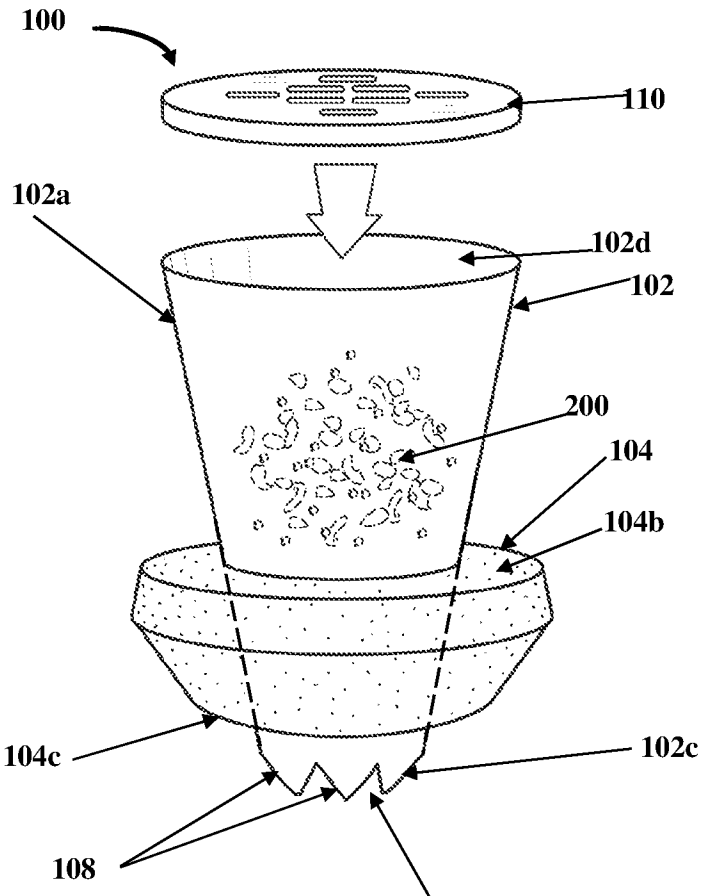
FIG. 3 illustrates a front elevational view showing a lid suspended above an open end of the receptacle of the first embodiment of the smoking cartridge, wherein the lid comprises perforations to allow for a flame or other lighting device to ignite the smoking material in the smoking cartridge.

FIG. 2 illustrates a front elevation view showing a receptacle 102 of the first embodiment of the smoking cartridge 100, corresponding to FIG. 1, with the smoking material 200 being loaded into the receptacle 102. In an embodiment, the smoking material 200 is inserted in to the receptacle 102 prior to use, or prior to sale or distribution to a user. FIG. 3 illustrates a front elevational view showing a lid 110 suspended above an open end 102*d* of the receptacle 120 of the first embodiment of the smoking cartridge 100, wherein the lid 110 comprises perforations 110*a* to allow for a flame or other lighting device to ignite the smoking material 200 in the smoking cartridge 100.

Figure 4A:
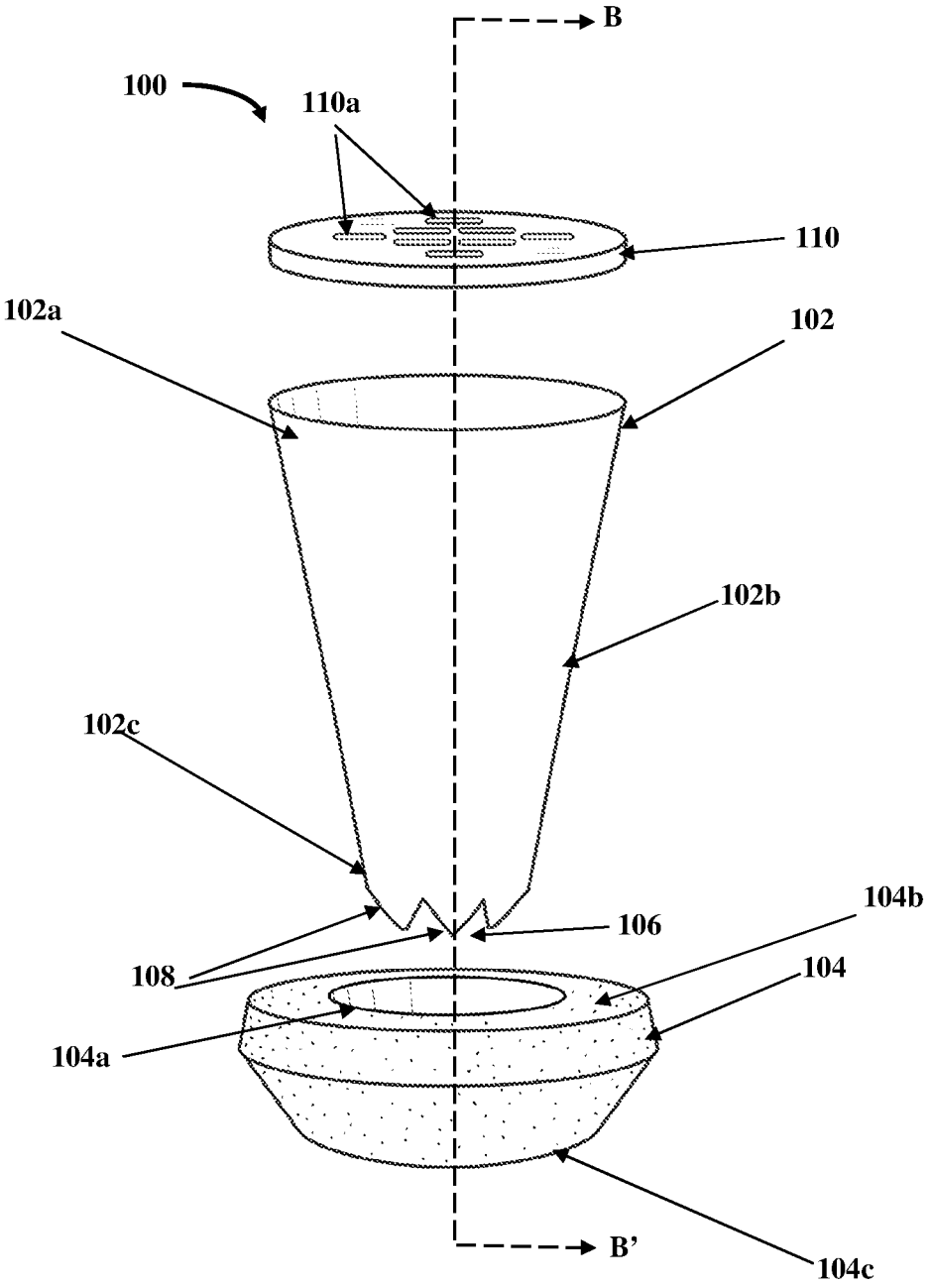
FIG. 4A illustrates an exploded view of the first embodiment of the smoking cartridge.
Figure 4B:
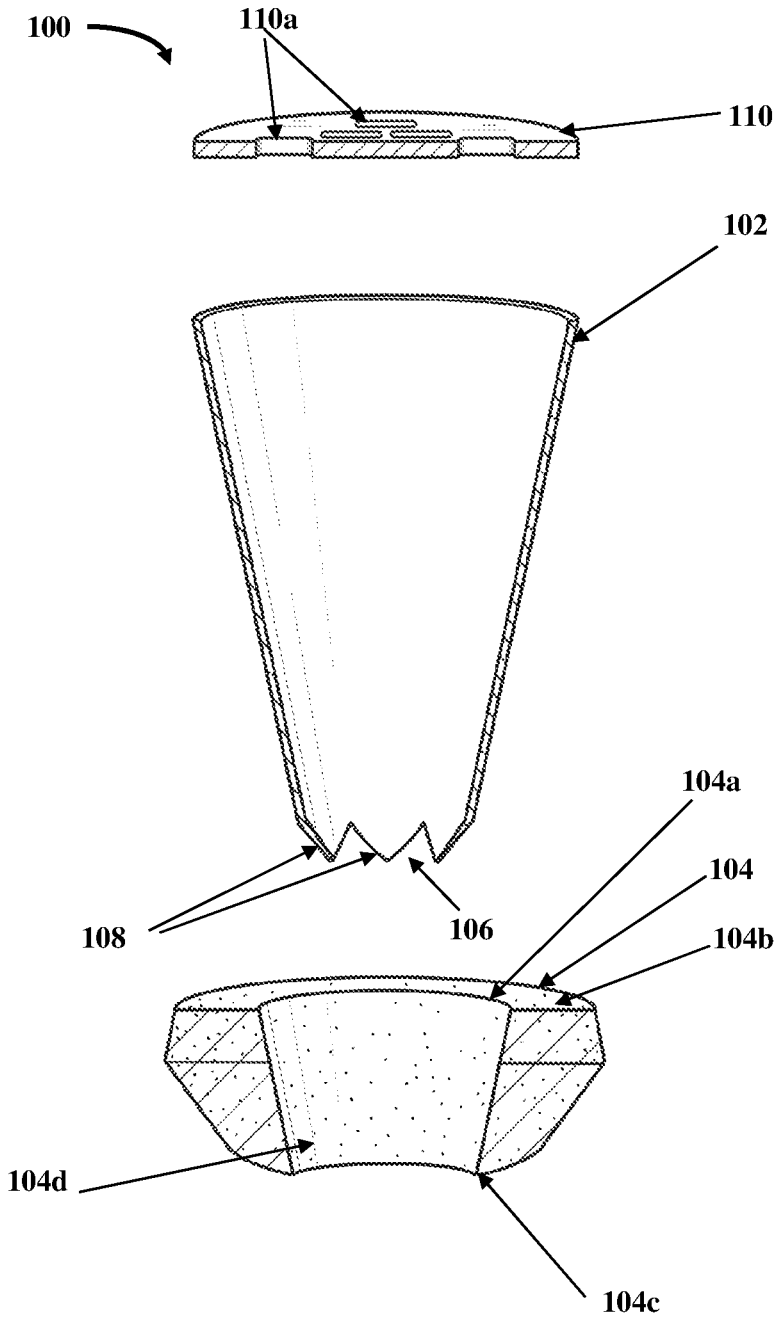
FIG. 4B illustrates a cross-sectional view of the exploded view of the first embodiment of the smoking cartridge shown in FIG. 4A, where the cross-section is obtained along line B-B' shown in FIG. 4A.

FIG. 4A illustrates an exploded view of the first embodiment of the smoking cartridge 100. FIG. 4B illustrates a cross-sectional view of the exploded view of the first embodiment of the smoking cartridge 100 shown in FIG. 4A, where the cross-section is obtained along line B-B' shown in FIG. 4A. As shown in FIGS. 4A and 4B, the sealing member 104 comprises a cavity 104*a* that extends along an entire thickness of the sealing member 104 from a top surface 104*b* to a bottom surface 104*c* of the sealing member 104. The bottom 102*c* section of the receptacle 102 is configured to removably engage with the cavity 104*a* through the top surface 104*b* of the sealing member 104. The bottom 102*c* of the receptacle 102 is positioned below the bottom surface 104*c* of the sealing member 104 until the sealing member 104 forms a tight fit around the periphery of the receptacle 102, proximal to a lower portion 102*b* of the receptacle 102. In an embodiment, a shape of the inner wall 104*d* of the cavity 104*a*, as shown in FIG. 4B, is about the same as the shape of the periphery of the receptacle 102, to create a tight fit between the periphery of the receptacle 102 and the inner wall 104*d* of the cavity 104*a* of the sealing member 104.

In an embodiment, the smoking material 200 in the receptacle 102 is lit from the open end 102*d* located at a top portion 102*a* of the receptacle 102 by removing the lid 110. In an embodiment, the lid 110 is removably secured to the open end 102*d* at the top portion 102*a* of the receptacle 102. The lid 110 comprises perforations 110*a* to allow ambient air to enter the receptacle 102 during combustion of the smoking material. The perforations 110*a* also allow smoke from the combustion of the smoking material 200 to exit the receptacle through the flaps 108 for inhalation by the smoker. The lid 110 also precludes ash from falling out of the open end 102*d* at the top portion 102*a* of the receptacle 102.

Figure 5:
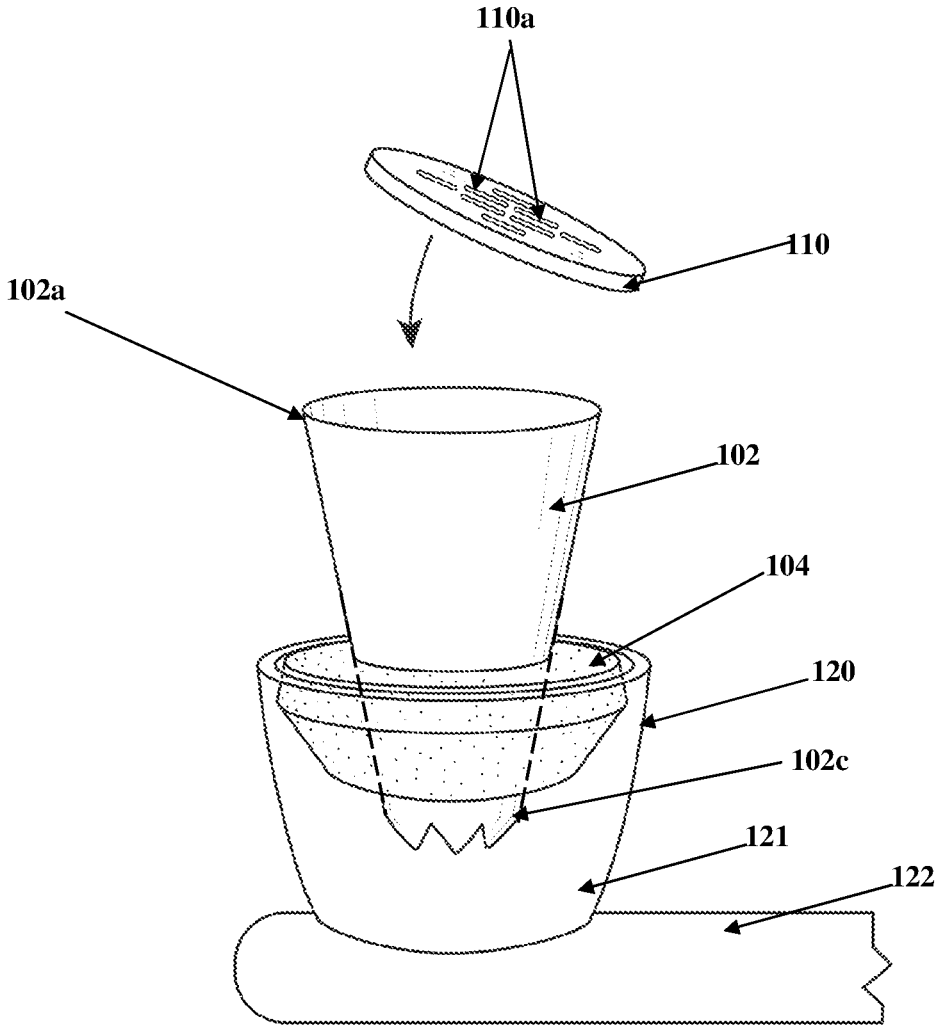
FIG. 5 illustrates a front elevational view showing the lid being placed at the top of the receptacle of the first embodiment of the smoking cartridge after the smoking material has been inserted into the receptacle.

FIG. 5 illustrates a front elevational view showing the lid 110 being placed at the top 102*a* of the receptacle 102 of the first embodiment of the smoking cartridge 100 after the smoking material 200 has been inserted into the receptacle 102. In an embodiment, the lid 110 is removably secured to the top 102*a* of the receptacle 102. The lid 110 is removably fastened to the top 102*a* of the receptacle 102 using a fastening mechanism integrated to the lid 110 and the top 102*a* of the receptacle 102. In an embodiment, the lid 110 is removably secured to the top 102*a* of the receptacle 102 using an adhesive. In an embodiment, the lid 110 is non-removably secured to the top 102*a* of the receptacle 102 to preclude the smoking material 200 from being accessed or tampered with. In an embodiment, the perforations 110*a* of the lid 110 are sealed using a tamper proof seal 1606 shown in FIG. 16. The tamper proof seal 1606 is, for example, a hologram security sticker. The tamper proof seal 1606 is removed by the user prior to using the smoking cartridge 100.

Figure 14:
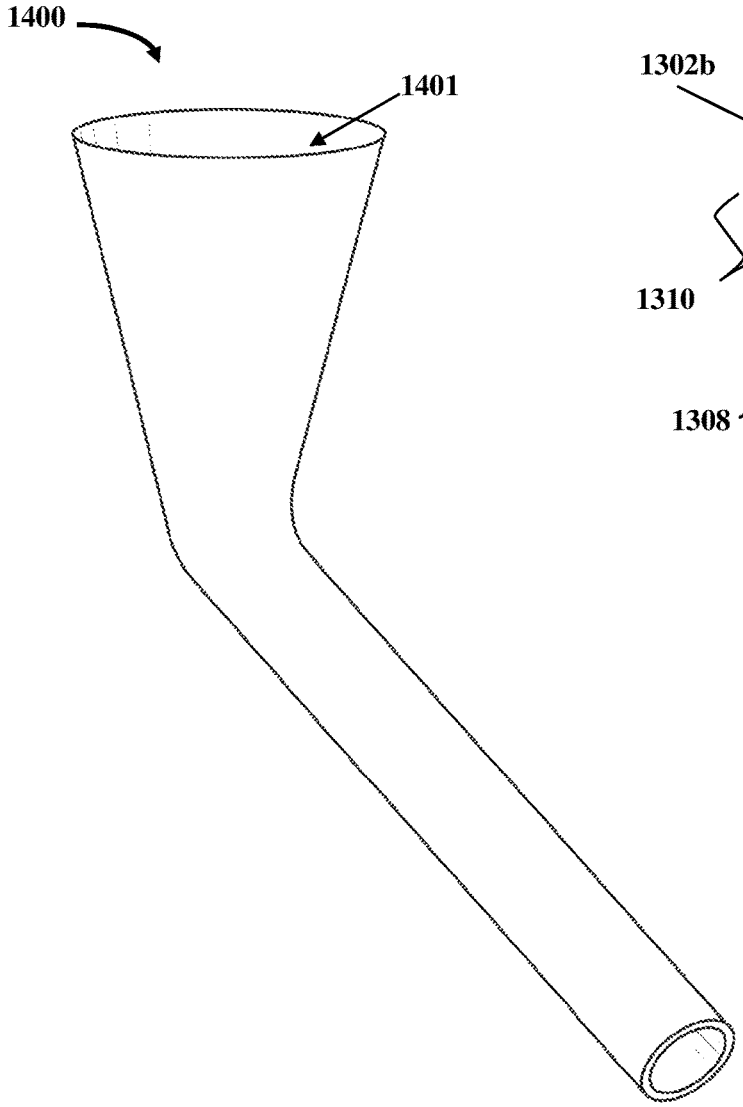
FIG. 14 illustrates a front perspective view of an angled stem of a bong.
Figure 15:
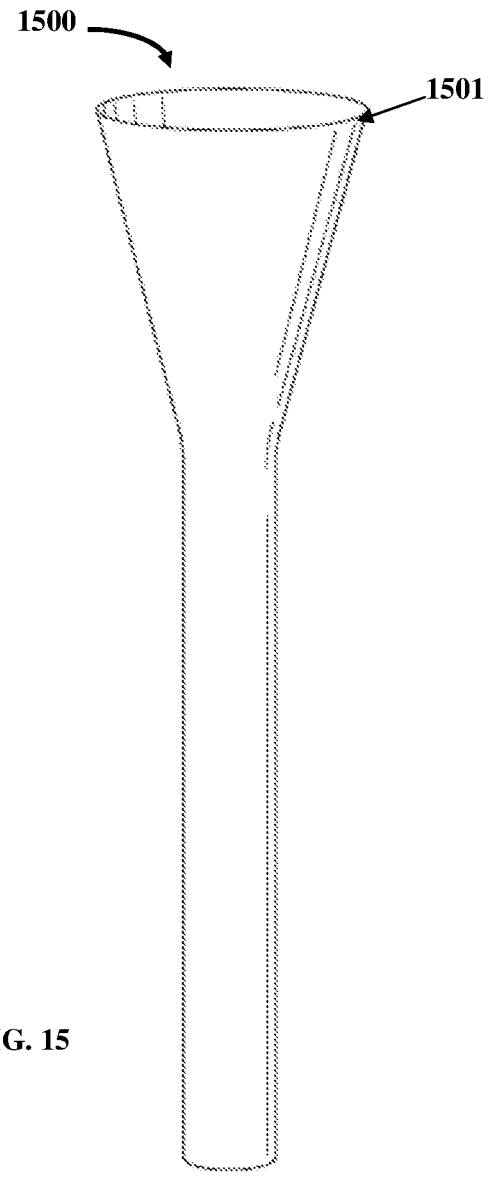
FIG. 15 illustrates a front elevation view of a straight stem of a bong.

In an embodiment, the receptacle 102 and the corresponding sealing member 104 have one of a cuboid shape, an elliptical shape, a conical shape, a frusto-conical shape, etc. In an embodiment, the receptacle 102 and the sealing member 104 have a substantially frusto-conical shape, as illustrated in FIGS. 1-9, 12 and 13, to allow the smoking cartridge 100 to be slidably and removably inserted in the bowl 121 of a smoking apparatus 120, as illustrated in FIGS. 4, 5, 10 and 11. As illustrated in FIG. 5, the sealing member 104 of the smoking cartridge 100 is generically configured to engage and seal with any bowl 121 of a smoking pipe 120, a bowl 1401 or bowl 1501 of a bong 1600 shown in FIGS. 16 and 17, etc. As illustrated in FIGS. 14 and 15, the frusto-conical shape of the sealing member 104 allows the smoking cartridge 100 to removably engage with any size bowl 121 of a smoking pipe 120, bowl 1401 or bowl 1501 of a bong 1600, etc. This precludes the need for the user to purchase a new smoking apparatus 120 or 1600 to use the smoking cartridge 100. The ability of the smoking cartridge 100 to fit into any size bowl 121 of a pipe 120, bowl 1401 or bowl 1501 of a bong 1600, etc., allows for a simpler and more cost-effective manufacturing process since the number of variations of the smoking cartridge 100 for different size smoking apparatuses 120, 1600 are reduced.

Figure 6:
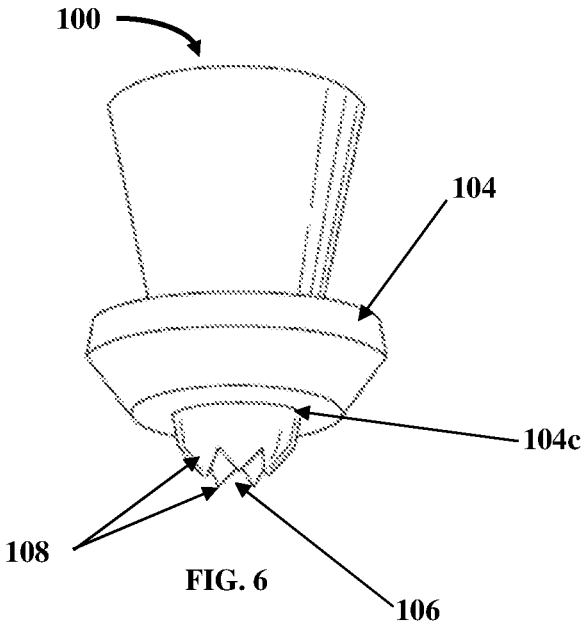
FIG. 6 illustrates a front perspective view of the first embodiment of the smoking cartridge.

FIG. 6 illustrates a front perspective view of the first embodiment of the smoking cartridge 100. The flaps 108 are shown bent in a downward direction to increase the size of the opening 106.

Figure 7:
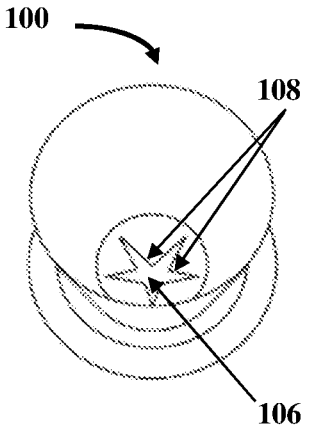
FIG. 7 illustrates a top perspective view of the first embodiment of the smoking cartridge.

FIG. 7 illustrates a top perspective view of the first embodiment of the smoking cartridge 100. As shown in FIG. 7, the flaps 108 define a generally star shaped opening 106.

Figure 8A:
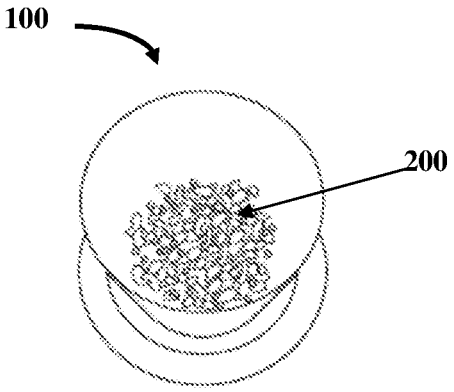
FIG. 8A illustrates a top perspective view of the first embodiment of the smoking cartridge illustrating a pre-measured amount of the smoking material in the receptacle before sale of the cartridge.

FIG. 8A illustrates a top perspective view of the first embodiment of the smoking cartridge 100 illustrating a pre-measured amount of the smoking material 200 in the receptacle 102 before sale of the cartridge 100. FIG. 8B illustrates a top perspective view of the first embodiment of the smoking cartridge 100 illustrating a screen 800 disposed over the opening 106 to preclude the smoking material 200 from falling down and out of the receptacle 102. The substantially star shaped structure of the flaps 108, as shown in FIG. 7, that defines the opening 106 precludes the screen 800 from slipping below through the opening 106, while the receptacle 102 is being loaded with the smoking material 200.

Figure 8C:
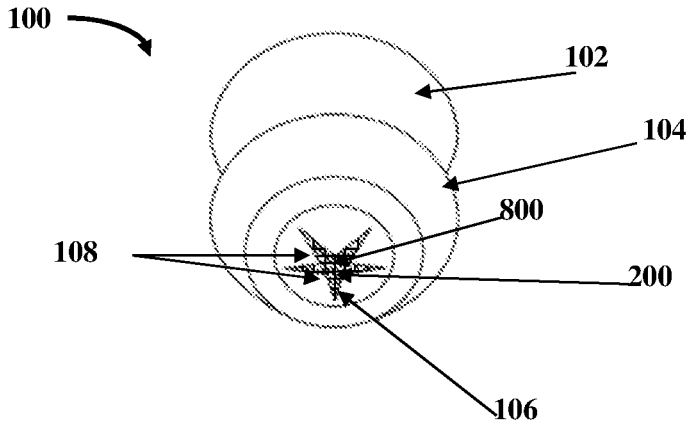
FIG. 8C illustrates a bottom perspective view of the first embodiment of the smoking cartridge with the smoking material.

FIG. 8C illustrates a bottom perspective view of the first embodiment of the smoking cartridge 100 with the smoking material 200. In an embodiment, the smoking cartridge 100 is used as a container for distribution of the smoking material 200. In an embodiment, the smoking material 200 is tobacco. In an embodiment, the smoking material 200 is *cannabis* flower material. When the *cannabis* flower material 200 is used as the smoking material in the smoking cartridge 100, the stem and seed are removed from the *cannabis* flower, the *cannabis* flower is ground to fine particles, and the *cannabis* particles are placed in a pre-measured amount in the receptacle 102 of the smoking cartridge 100 by the distributor prior to distribution or use by a user. Providing smoking cartridges 100 with prefilled smoking material 200 adds value to the product being sold by the distributor as the *cannabis* particle cartridge filling tasks described above are negated. The smoking cartridges 100 with prefilled smoking material 200 eliminates the user's need for the above *cannabis* grinding and cartridge filling task(s) as these tasks are performed at a licensed or State controlled facility.

The smoking cartridge 100 with prefilled smoking material 200 can be immediately and readily used by a user. Providing cartridges 100 with prefilled smoking material 200 is also convenient for users with dexterity related illnesses, for example, multiple sclerosis (MS), finger arthritis, etc. Users with multiple sclerosis are prescribed *cannabis* as these users are often unable to perform the above *cannabis* grinding and cartridge filling tasks. When unable to do so, many users must request assistance from others requiring the user to divulge the use of the *cannabis* medication which is not desirable in many cases. The smoking cartridges 100 with prefilled smoking material 200, for example, ground *cannabis* flower, overcomes the above problem for the user and adds value to the distributor. The user can simply use the delivered smoking cartridge 100 with prefilled smoking material 200 in his smoking pipe or bong.

FIG. 9A illustrates a bottom isometric view of the receptacle 102 of the first embodiment of the smoking cartridge 100, showing the flaps at the bottom of the receptacle 102. As illustrated in FIG. 9A, the receptacle comprises about 5 flaps 108. In the embodiment where the receptacle 102 is made of a sheet of metal, each of the flaps 108 can be bent and/or pivoted easily and individually about the lower circumference of the receptacle 102. FIG. 9B illustrates a bottom isometric view of the receptacle 102 of the first embodiment of the smoking cartridge 100 showing flaps 108 of the receptacle 102 bent inwards. FIG. 9C illustrates a bottom isometric view of the receptacle 102 of the first embodiment of the smoking cartridge 100 showing flaps 108 of the receptacle 102 bent outwards.

Figure 10A:
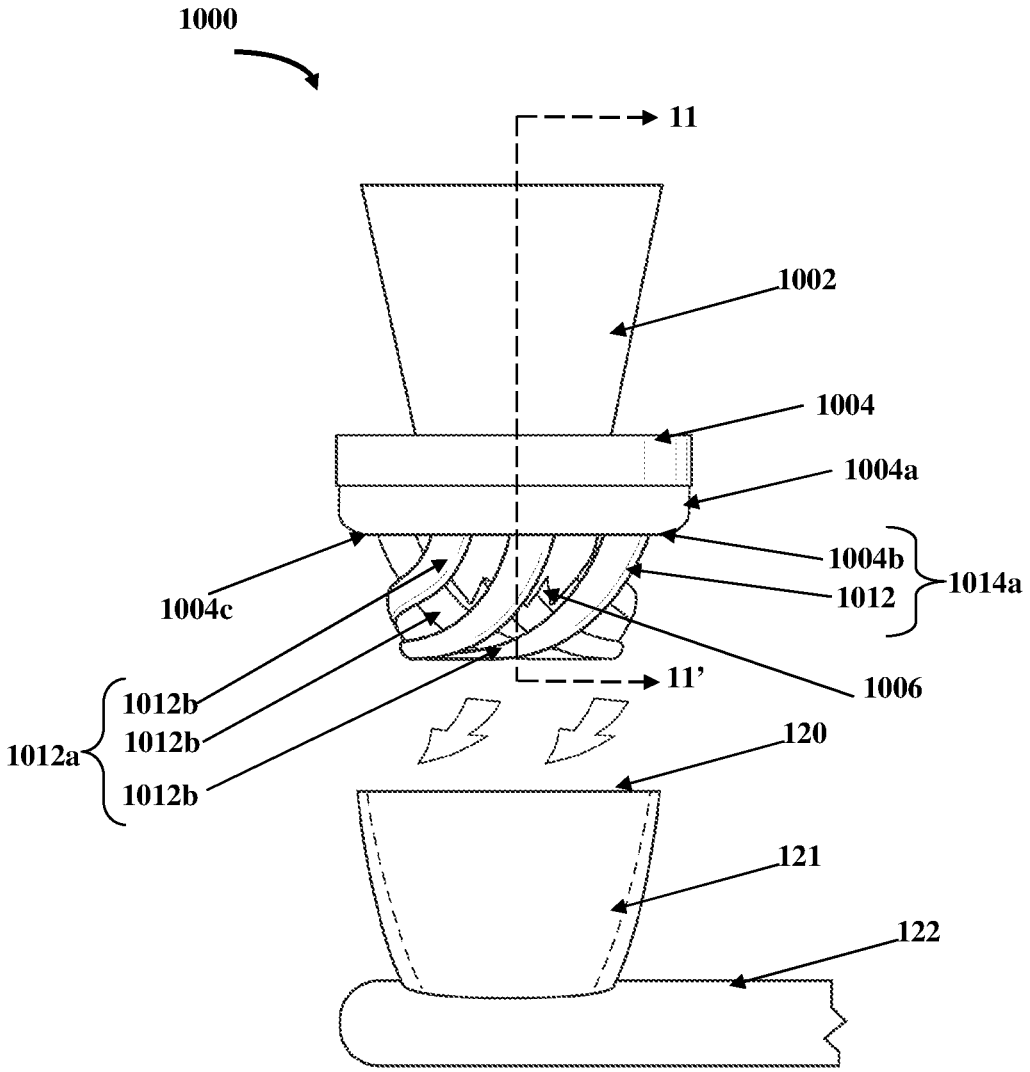
FIG. 10A illustrates a front elevational view of a second embodiment of the smoking cartridge being lowered into the bowl of the smoking apparatus.

FIG. 10A illustrates a front elevational view of a second embodiment of the smoking cartridge 1000 being lowered into the bowl 121 of the smoking apparatus 120. The smoking cartridge 1000 comprises a receptacle 1002, a sealing member 1004, and a stabilizer 1014*a*. The stabilizer 1014*a* precludes the smoking cartridge 1000 from falling off the smoking pipe 120 during smoking. The stabilizer 1014*a* comprises a threaded extension 1012 disposed below the sealing member 1004 and in communication with the receptacle 1002. The threaded extension 1012 comprises a threaded surface 1012*a*.

Figure 10B:
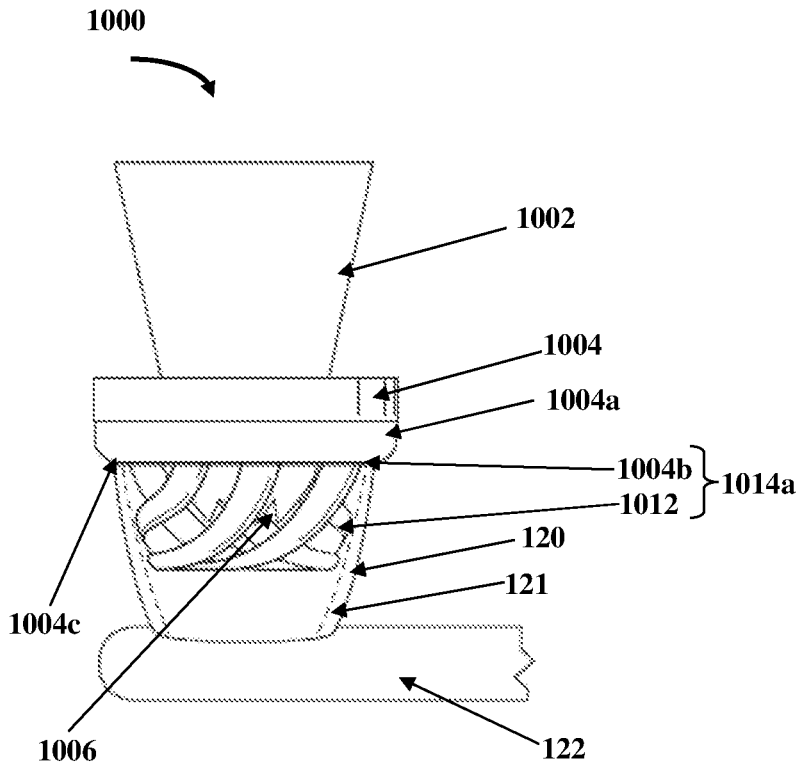
FIG. 10B illustrates a front elevational view of the second embodiment of the smoking cartridge secured to the bowl of the smoking apparatus using a first embodiment of a stabilizer comprising an adhesive layer at a bottom surface of the sealing member and a second embodiment of the stabilizer comprising threaded extension.
Figure 11A:
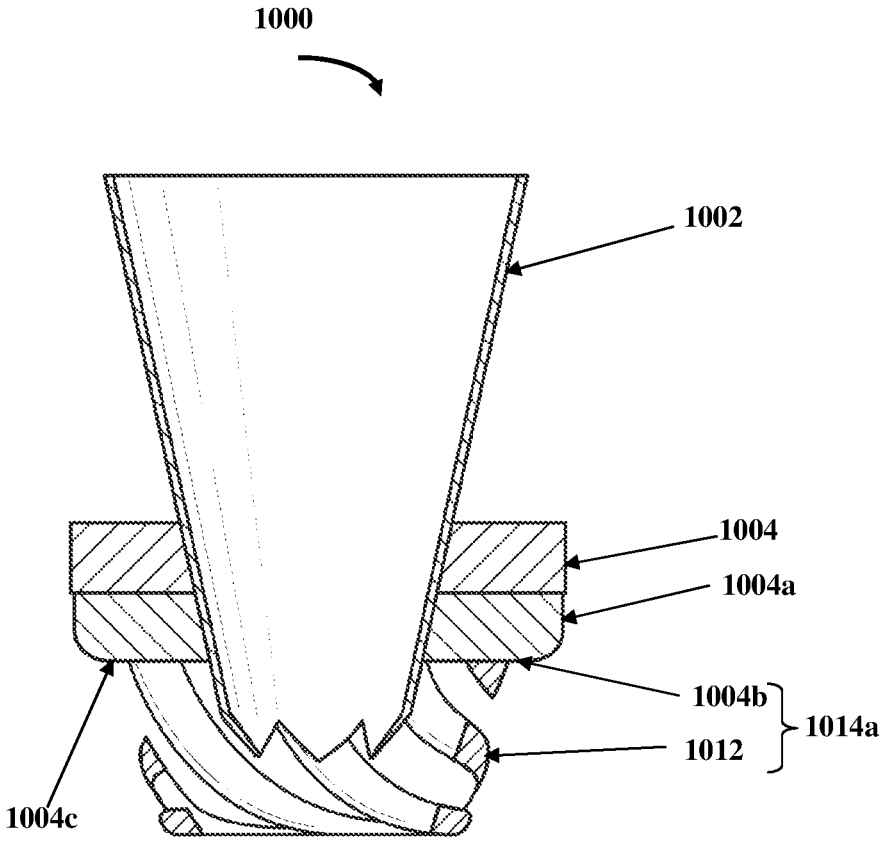
FIG. 11A illustrates a cross-sectional view of the second embodiment of the smoking cartridge shown in FIG. 10A, where the cross-section is obtained along line 11-11' shown in FIG. 10A.
Figure 11B:
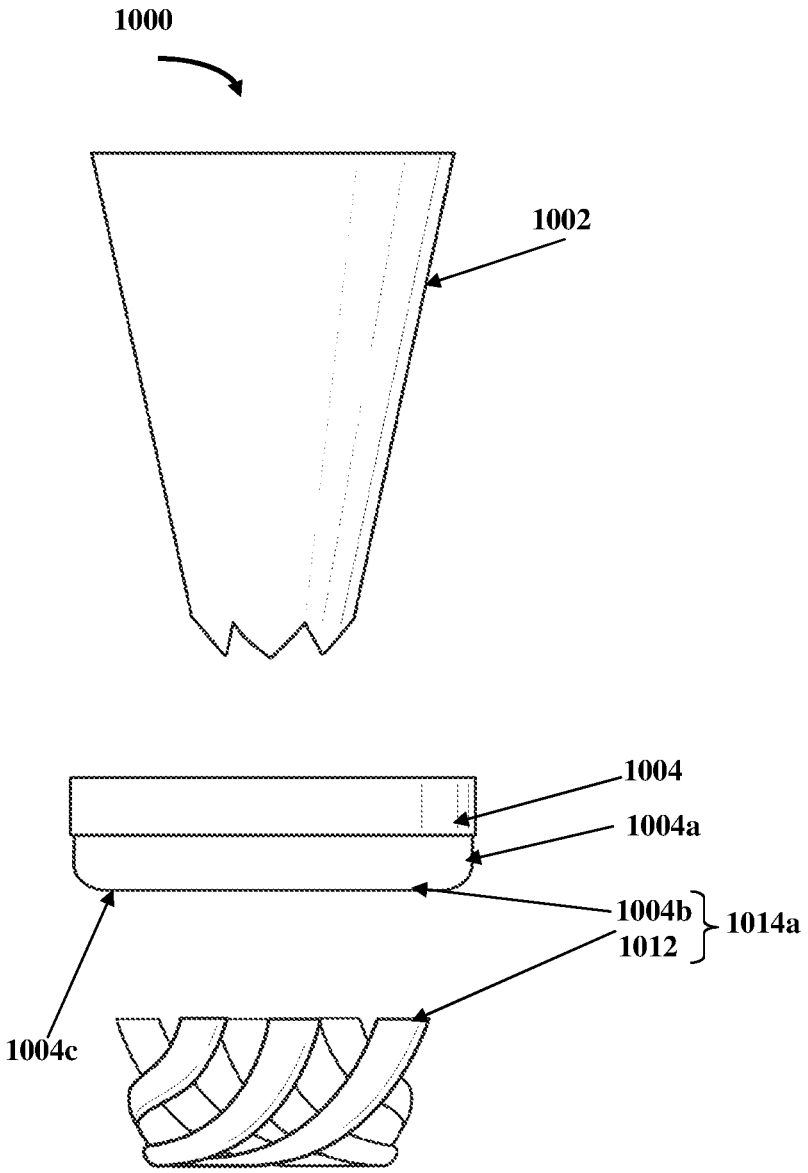
FIG. 11B illustrates an exploded view of the second embodiment of the smoking cartridge.

FIG. 10B illustrates a front elevational view of the second embodiment of the smoking cartridge 1000 secured to the bowl 121 of the smoking apparatus 120 using a first embodiment of the stabilizer 1014*a* comprising an adhesive layer 1004*b* disposed at a bottom surface 1004*c* of the sealing member 1004 and a second embodiment of the stabilizer 1014*a* comprising a threaded extension 1012. FIG. 11A illustrates a cross-sectional view of the second embodiment of the smoking cartridge 1000 shown in FIG. 10A, where the cross-section is obtained along line 11-11' shown in FIG. 10A. FIG. 11B illustrates an exploded view of the second embodiment of the smoking cartridge 1000. The adhesive layer 1004*b* is configured to removably engage the smoking cartridge 1000 with the smoking pipe 120. The smoking cartridge 1000 is placed on top of the bowl 121 of the smoking pipe 120 with the opening 1006 at the bottom 102*c* of the receptacle 102 projecting into the bowl 121 as illustrated in FIG. 10B. The adhesive layer 1004*b* removably engages with the bowl 121 of the smoking pipe 120 to securely engage the smoking cartridge 1000 with the bowl 121. The adhesive layer 1004*b* positioned on a ring 1004*a* of the sealing member 1004 is a non-toxic, heat resistant adhesive and creates an air tight engagement with the bowl 121 of the smoking pipe 120 and the bowl 1401 or 1501 of a bong 1600.

As illustrated in FIGS. 10A and 10B, in the second embodiment, the stabilizer 1014*a* comprises a threaded extension 1012 disposed below the sealing member 1004 and in communication with the receptacle 1002. The threaded extension 1012 comprises a threaded surface 1012*a* which provides an air tight seal between the smoking cartridge 1000 and the bowl 121 of the pipe smoking 120 or the bowl 1401, 1501 of the bong 1400, 1500, after engagement between the smoking cartridge 1000 and the bowl 1401. In an embodiment, the threaded surface 1012*a* of the threaded extension 1012 is formed by intertwining multiple elongate elastic members 1012*b*, as shown in FIG. 10, to provide substantially elastic properties to the threaded extension 1012 to securely fit within the bowl 121.

Figure 12:
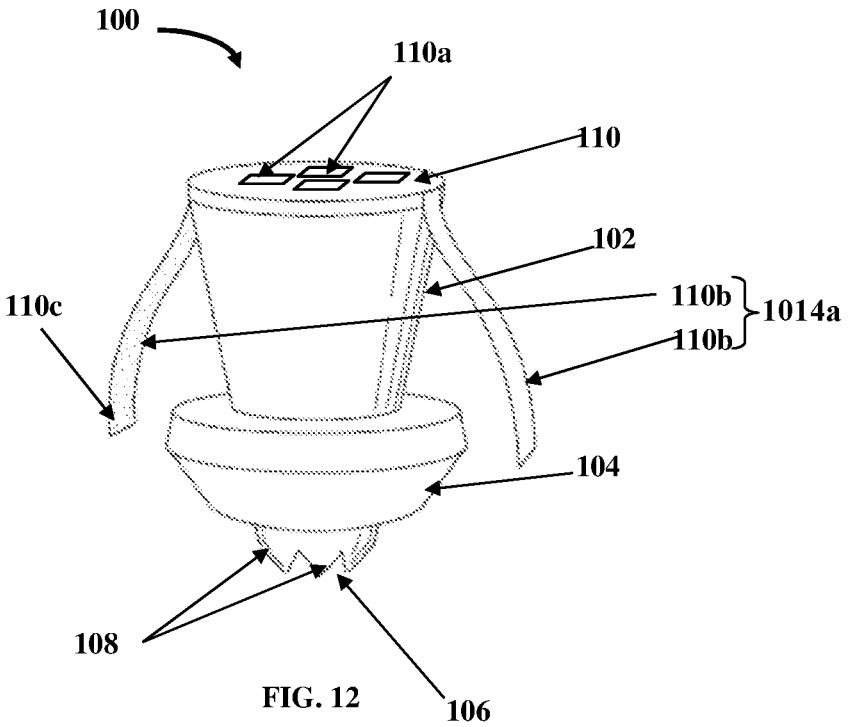
FIG. 12 illustrates a front elevational view of the first embodiment of the smoking cartridge showing a third embodiment of the stabilizer comprising adhesive strips attached to the lid of the smoking cartridge, wherein the lid of the cartridge further comprises perforations that vary in size.

FIG. 12 illustrates a front elevational view of the first embodiment of the smoking cartridge 100 showing a third embodiment of a stabilizer 1014*a*. As shown in FIG. 12, the third embodiment of the stabilizer 1014*a* comprises two or more adhesive strips 110*b* attached to the lid 110 of the smoking cartridge 100. The lid 110 of the smoking cartridge 100 further comprises perforations 110*a* that in an embodiment vary in size. The adhesive strips 110*b* comprise an adhesive layer 110*c* applied on one side of the adhesive strip. The adhesive strips 110*b* are attached to the lid 110 of the smoking cartridge 100. The lid 110 is fastened to the receptacle 102 and the adhesive strips 110*b* are fastened to the smoking pipe 120 to secure the smoking cartridge 100 to the smoking pipe 120.

Figure 13:
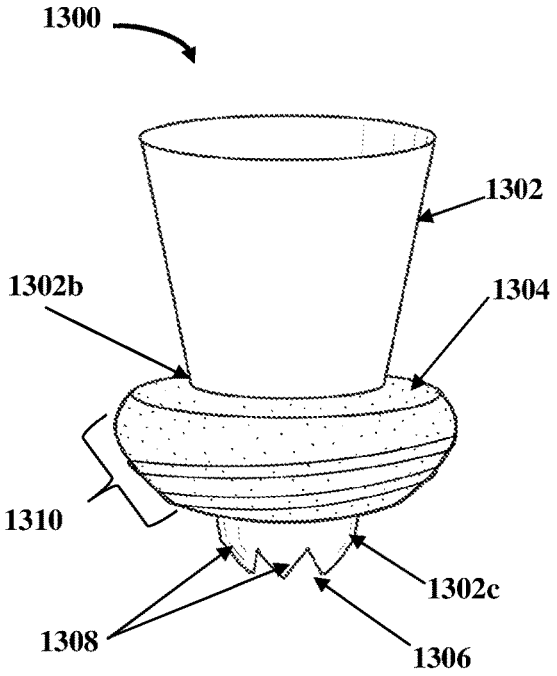
FIG. 13 illustrates a front elevational view of a third embodiment of the smoking cartridge.

FIG. 13 illustrates a front elevational view of the third embodiment of the smoking cartridge 1300. The third embodiment of the smoking cartridge 1300 is similar to the first embodiment of the smoking cartridge 100. The third embodiment of the smoking cartridge 1300 also comprises a receptacle 1302 configured to contain a smoking material 200, a sealing member 1304 that is disposed along the periphery the receptacle 1302 proximal to a lower portion 1302*b* of the receptacle 1302. The smoking cartridge 1300 further comprises an opening 1306 disposed at a bottom 1302*c* of the receptacle 1302. The opening 1306 comprises inwardly projecting adjustable flaps 1308. The sealing member 1304 of the third embodiment of the smoking cartridge 1300 comprises the side 1310 of the sealing member 1304 threaded, as shown in FIG. 13. The threaded side 1310 of the sealing member 1304 engages with an inner wall 121*a* of bowl 121 of the smoking apparatus 120 when the smoking cartridge 100 is inserted into bowl 121 and turned in a clockwise direction. The threaded side 1310 of the sealing member 1304 creates a tight seal between the inner wall 121*a* of the bowl 121 of the smoking apparatus 120 and the sealing member 1304.

Figure 16:
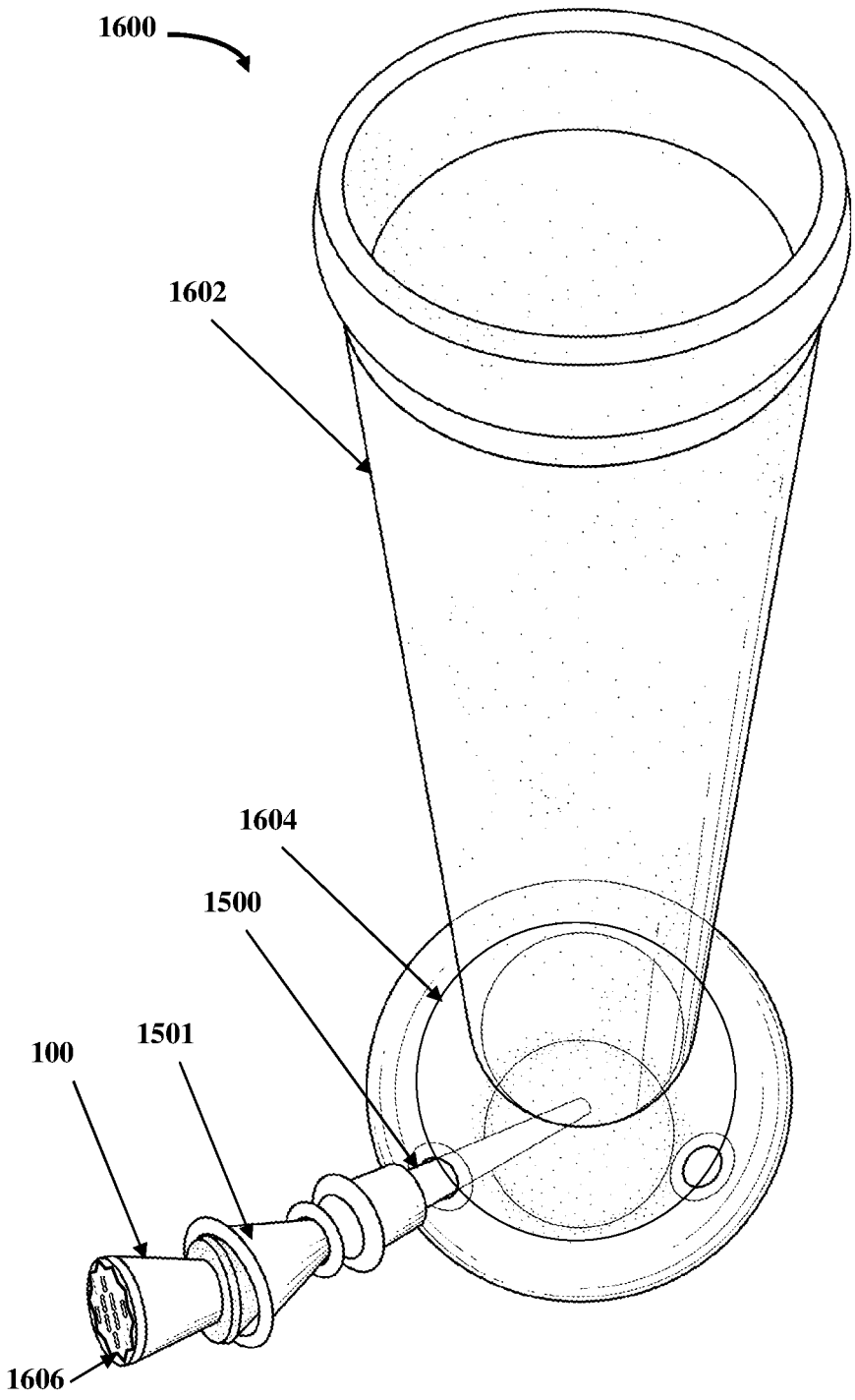
FIG. 16 illustrates a top perspective view of a bong comprising the straight stem and the first embodiment of the smoking cartridge inserted in the bowl of the straight stem.
Figure 17:
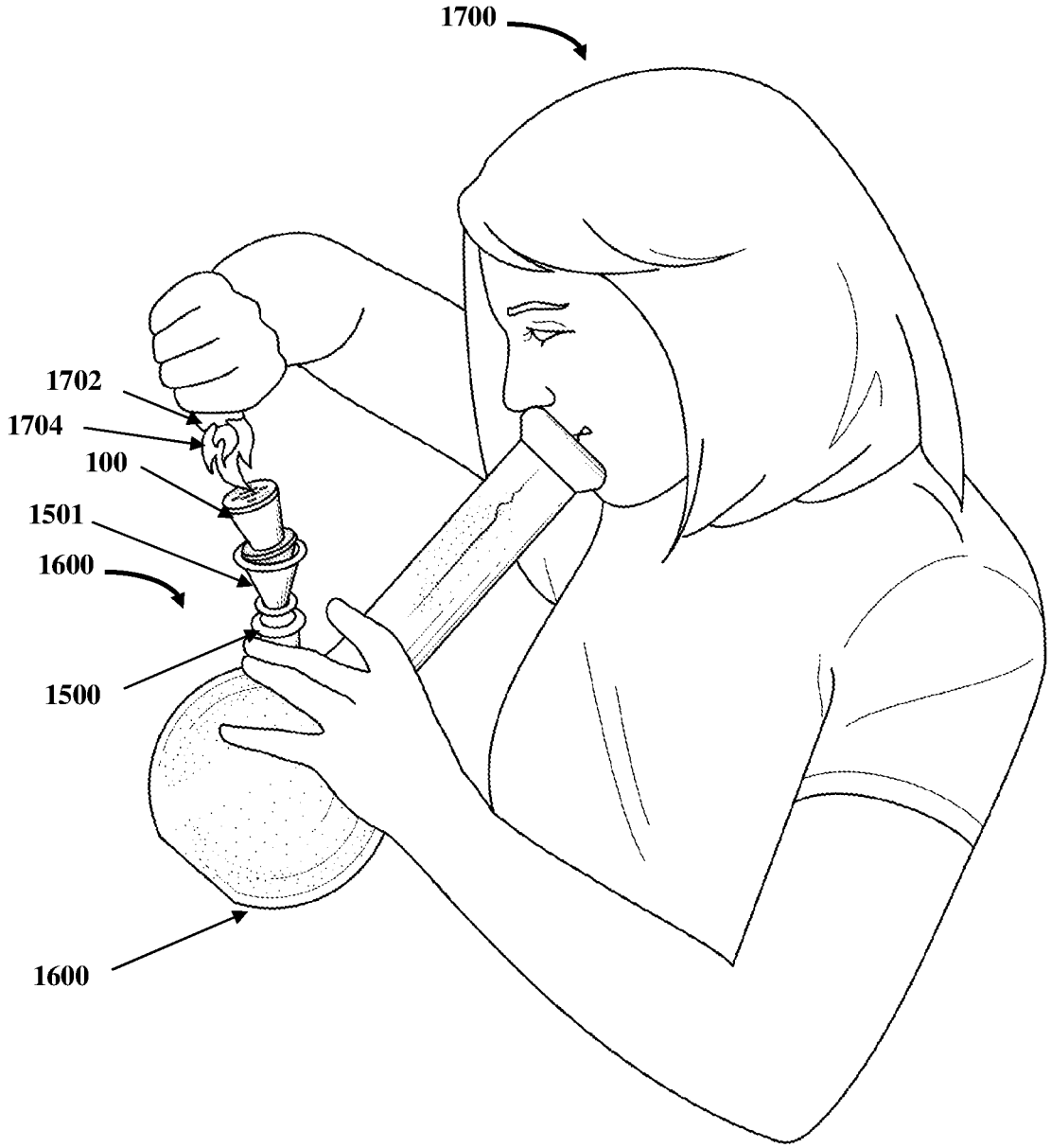
FIG. 17 illustrates a user using a bong with the first embodiment of the smoking cartridge.

FIG. 14 illustrates a front perspective view of an angled stem 1400 of a bong 1600. FIG. 15 illustrates a front elevation view of a straight stem 1500 of a bong 1600. The smoking cartridges 100 and 1000 are similarly secured to bowls 1401 and 1501 of the angled stem 1400 of a bong 1600 and the straight stem 1500 of a bong 1600, respectively. FIG. 16 illustrates a top perspective view of a bong 1600 comprising the straight stem 1500 and the first embodiment of the smoking cartridge 100 inserted in the straight stem. FIG. 17 illustrates a user 1700 using a bong 1600 with the first embodiment of the smoking cartridge 100. As illustrated in FIG. 17, to use the bong 1600, the user ignites the smoking material 200 using a lighting device 1702. A flame 1704 generated by the lighting device 1702 passes through the perforations 110*a* in the lid 110 and ignites the smoking material 200 packaged within the smoking cartridge 100. The user 1700 draws the smoke generated by the smoking material 200 through a mouthpiece 1602 of the bong 1600. The smoke is filtered by water 1604 in the bong 1600 as the smoke passes through water 1604 in the bong 1600, prior to the inhalation of the smoke by the user 1700.

The embodiments of the smoking cartridges 100, 1000 and 1300 disclosed herein resolve the market needs at manufacturing, distribution, and end user level(s). The smoking cartridges 100, 1000 and 1300 disclosed herein comprise multiple features that address the long felt needs of the market. For example, in an embodiment, the smoking cartridges 100, 1000 and 1300 comprise a receptacle 102 and 1002 that holds pre-measured amounts of de-stemmed and de-seeded *cannabis* plant flower material which has been prepared for smoking. This feature fulfils the need for providing predetermined doses of *cannabis* material in a ready to consume package that can be directly engaged with the users' 1700 existing smoking apparatus 120 and 1600, allowing the users to smoke the *cannabis* material directly from the package in which the *cannabis* material was delivered.

In an embodiment, the perforations 110*a* on the lid 110 are sealed using a tamper proof seal 1606, as shown in FIG. 16. The tamper proof seal 1606 is, for example, a hologram security sticker. The tamper proof 1606 seal is removed prior to lighting up and smoking the smoking cartridge 100. The tamper proof seal 1606 ensures the integrity of the smoking content of the smoking cartridge 100. Removing the tamper proof seal 1606 opens the perforations 110*a* in the lid 110 enabling a user 1700 to draw air through the smoking cartridge 100 and smoke the smoking material 200 using the smoking pipe 120.

The foregoing examples have been provided merely for explanation and are in no way to be construed as limiting of the smoking cartridges 100, 1000 and 1300 disclosed herein. While the smoking cartridges 100, 1000 and 1300 have been described with reference to various embodiments, it is understood that the words, which have been used herein, are words of description and illustration, rather than words of limitation. Furthermore, although the smoking cartridges 100, 1000 and 1300 have been described herein with reference to particular means, materials, and embodiments, the cartridges 100, 1000 and 1300 are not intended to be limited to the particulars disclosed herein; rather, the smoking cartridges 100, 1000 and 1300 extend to all functionally equivalent structures, methods and uses, such as are within the scope of the appended claims. While multiple embodiments are disclosed, it will be understood by those skilled in the art, having the benefit of the teachings of this specification, that the smoking cartridges 100, 1000 and 1300 disclosed herein are capable of modifications and other embodiments may be effected and changes may be made thereto, without departing from the scope and spirit of the smoking cartridges 100, 1000 and 1300 disclosed herein.

I claim:

1. A smoking cartridge for removably engaging with a bowl of a smoking apparatus, comprising:

a receptacle containing a smoking material;

a sealing member disposed along the periphery of the receptacle proximal to a lower portion of the receptacle, wherein the sealing member engages with the bowl of the smoking apparatus;

a plurality of adjustable flaps pivoting about a circumference of a bottom of the receptacle, wherein the plurality of adjustable flaps bend (a) inwards towards an opening at a center of the bottom of the receptacle or (b) outwards from the opening at the center of the bottom of the receptacle, and wherein the bending of the plurality of adjustable flaps varies a size of the opening at the center of the bottom of the receptacle; and a stabilizer attached to the sealing member, wherein the stabilizer comprises one or more of an adhesive layer and a threaded extension, wherein the threaded extension comprises a threaded fitting for providing an air tight seal between the smoking cartridge and the bowl when the smoking cartridge is engaged with the bowl of the smoking apparatus, and wherein a threaded side of the threaded extension comprises an intertwining plurality of elongate elastic members to provide substantially elastic properties to the threaded extension to securely engage within the bowl of the smoking apparatus.

2. The smoking cartridge of claim 1, wherein the plurality of adjustable flaps allow smoke generated by the combustion of the smoking material to exit the receptacle and preclude the smoking material from falling out from the bottom of the receptacle.

3. The smoking cartridge of claim 1, further comprising a lid removably engaged with an opening at a top portion of the receptacle, wherein the lid comprises a plurality of perforations to allow air to enter the receptacle.

4. The smoking cartridge of claim 1, further comprising a lid non-removably engaged with an opening at a top portion of the receptacle to preclude the smoking material within the smoking cartridge from being accessed or tampered with, wherein the lid comprises a plurality of perforations to allow air to enter the receptacle.

5. The smoking cartridge of claim 3, wherein the perforations of the lid are sealed using a tamper proof seal, wherein the tamper proof seal is removed prior to using the smoking cartridge to enable a user to draw the air through the smoking cartridge and smoke the smoking material using the smoking apparatus.

6. The smoking cartridge of claim 4, wherein the perforations of the lid are sealed using a tamper proof seal, wherein the tamper proof seal is removed prior to using the smoking cartridge to enable a user to draw the air through the smoking cartridge and smoke the smoking material using the smoking apparatus.

7. The smoking cartridge of claim 1, wherein the adhesive layer removably engages with the bowl of the smoking apparatus to secure the smoking cartridge within the bowl.

8. The smoking cartridge of claim 7, wherein the adhesive layer disposed on a ring of the sealing member is a non-toxic and heat resistant adhesive for precluding ingress of ambient air into the bowl between the periphery of the cartridge and the bowl within which the cartridge is disposed.

* * * * *